US007374411B2

(12) United States Patent
Nakakuki et al.

(10) Patent No.: US 7,374,411 B2
(45) Date of Patent: May 20, 2008

(54) OIL PUMP ADAPTED TO PREVENT LEAKAGE WITHOUT USING SEALING MEMBER

(75) Inventors: Yasuhito Nakakuki, Kanagawa (JP); Toshimitsu Sakaki, Kanagawa (JP)

(73) Assignee: Hitachi, Ltd., Tokyo (JP)

( * ) Notice: Subject to any disclaimer, the term of this patent is extended or adjusted under 35 U.S.C. 154(b) by 337 days.

(21) Appl. No.: 11/185,812

(22) Filed: Jul. 21, 2005

(65) Prior Publication Data

US 2006/0018768 A1 Jan. 26, 2006

(30) Foreign Application Priority Data

Jul. 21, 2004 (JP) ..... 2004-212398

(51) Int. Cl.
*F03C 4/00* (2006.01)
*F04C 15/00* (2006.01)
*F04C 2/00* (2006.01)

(52) U.S. Cl. ..... 418/179; 418/32; 418/132; 418/171

(58) Field of Classification Search ..... 418/32, 418/130–132, 178, 179, 166, 171, 206.1, 418/259, 260, 266–268
See application file for complete search history.

(56) References Cited

U.S. PATENT DOCUMENTS 4,492,545 A * 1/1985 Mochizuki et al. ..... 418/179
5,876,192 A 3/1999 Follmer
6,402,488 B2 * 6/2002 Watanabe et al. ..... 418/179
2006/0140811 A1 6/2006 Bachmann et al.

FOREIGN PATENT DOCUMENTS

| | | | |
|---|---|---|---|
| DE | 103 31 979 A1 | | 2/2005 |
| JP | 58-183992 U | | 12/1983 |
| JP | 62048983 A | * | 3/1987 |
| JP | 62-223487 A | | 10/1987 |
| JP | 06085284 A | * | 3/1994 |
| JP | 08042418 A | * | 2/1996 |
| JP | 2001193669 A | * | 7/2001 |

* cited by examiner

*Primary Examiner*—Theresa Trieu
(74) *Attorney, Agent, or Firm*—Foley & Lardner LLP

(57) ABSTRACT

An oil pump is provided which includes a cam ring made of a material having a first line expansion coefficient, a pump element rotatably disposed in the cam ring and smaller in an axial length than the cam ring, a first housing member disposed on one of axially opposite sides of the cam ring and made of a material having a second line expansion coefficient larger than the first line expansion coefficient, and a second housing member disposed on the other of the axially opposite sides of the cam ring and made of a material having a third line expansion coefficient than the first line expansion coefficient.

10 Claims, 4 Drawing Sheets

OIL PUMP ADAPTED TO PREVENT LEAKAGE WITHOUT USING SEALING MEMBER

BACKGROUND OF THE INVENTION

The present invention relates to an oil pump, for example, for supplying lubrication oil to sliding sections of an automotive vehicle or for supplying pressurized oil to a power cylinder of a power steering system for assisting steering.

An oil pump, for example, for use in automotive vehicles has a pump housing and a housing cover that are made of an aluminum alloy of a small specific gravity. The oil pump further has a cam ring made of an iron-system material, which cam ring is required to have a large strength.

In case, as described above, the pump housing and the housing cover are made of a metal of a larger line expansion coefficient and the cam ring is made of a metal of a smaller line expansion coefficient, they make different displacements due to thermal expansion in accordance with a temperature rise of working oil in the pump, thus increasing side clearances between them.

As a result, there occurs leakage of working oil through the side clearances and therefore a decrease in the pump efficiency.

Thus, there has been proposed, as disclosed in Japanese Utility Model Publication No. 58-183992, such an oil pump in which a spacer is disposed in a space surrounded by a housing and a housing cover, which spacer has a thermal expansion coefficient that compensates for an increase of a side clearance due to a difference in thermal expansion between a pump operating section and its surrounding section and which spacer has a sealing function to prevent leakage of working oil through the side clearance.

SUMMARY OF THE INVENTION

However, the oil pump disclosed in the above-described Utility Model Publication is configured so that a particular spacer is disposed in the surrounded space, thus causing the oil pump to inevitably become complicated in structure, lowering the manufacturing and assembling efficiencies and increasing the cost.

It is accordingly an object of the present invention to provide an oil pump that is free from the problem inherent in the prior art device.

To achieve the above object, there is provided according to an aspect of the present invention an oil pump comprising a cam ring made of a material having a first line expansion coefficient, a pump element rotatably disposed in the cam ring and smaller in an axial length than the cam ring, a drive shaft for driving the pump element, a first housing member disposed on one of axially opposite sides of the cam ring, made of a material having a second line expansion coefficient larger than the first line expansion coefficient and having a first abutment surface in abutting engagement with one of opposite axial end surfaces of the cam ring and a second abutment surface in abutting engagement with one of opposite axial end surfaces of the pump element, a second housing member disposed on the other of the axially opposite sides of the cam ring, made of a material having a third line expansion coefficient larger than the first line expansion coefficient and having a third abutment surface in abutting engagement with the other of the opposite axial end surfaces of the cam ring and a fourth abutment surface in abutting engagement with the other of the opposite axial end surfaces of the pump element, an intake port formed in one of the first housing member and the second housing member at a position corresponding to an intake range of the pump element, and a discharge port formed in one of the first housing member and the second housing member at a position corresponding to a discharge range of the pump element.

By this, when the operation of oil pump causes a temperature rise of working oil and therefore thermal expansion of the cam ring and the first and second housing members, the first and second housing members are moved relative to the cam ring by substantially the same amount in the direction to hold therebetween the cam ring since the first and second housing members are larger in the line expansion coefficient than the cam ring.

For this reason, the side clearance between each of the second and fourth abutment surfaces of the housing members and each of the opposite axial end surfaces of the pump element is decreased. Simultaneously with this, a space between each of the first and third abutment surfaces of the housing members and each of the opposite axial end surfaces of the cam ring is eliminated, and therefore the housing members are brought into fitting contact with the cam ring.

As a result, it becomes possible to prevent highly pressurized working oil within pump chambers from leaking to the outside through the respective side clearances.

Further, at low temperature, i.e., when the viscosity resistance of working oil is high, displacement of the housing members toward the pump element is small and therefore a suitably large side clearance is obtained, thus making it possible to prevent occurrence of rotational sliding resistance of the pump element.

According to a further aspect of the present invention, there is provided an oil pump comprising a cam ring made of a material having a first line expansion coefficient, a pump element having an internal gear rotatably disposed in the cam ring and an external gear meshed with the internal gear, a drive shaft for driving the external gear, a first housing member disposed on one of axially opposite sides of the cam ring and made of a material having a second line expansion coefficient larger than the first line expansion coefficient, a second housing member disposed on the other of the axially opposite sides of the cam ring and made of a material having a third line expansion coefficient larger than the first line expansion coefficient, an intake port formed in one of the first housing member and the second housing member so as to be open to a plurality of pump chambers of the pump element, which are in a range where the pump chambers increase in volume in accordance with rotation of the drive shaft, a discharge port formed in one of the first housing member and the second housing member so as to be open to a plurality of pump chambers of the pump element, which are in a range where the pump chambers decrease in volume in accordance with rotation of the drive shaft, a first axial hole formed in the cam ring at a circumferential position corresponding to a deepest mesh portion where corresponding one of the pump chambers becomes minimum in volume, a second axial hole formed in the cam ring at a circumferential position corresponding to a shallowest mesh portion where corresponding one of the pump chambers becomes maximum in volume, a first positioning pin press-fitted in the first axial hole and in an axial hole formed in one of the first housing member and the second housing member, and a second positioning pin press-fitted in the second axial hole and in an axial hole formed in one of the first housing member and the second housing member, wherein the first axial hole corresponds in shape to the first positioning pin, and wherein the second axial hole has a smaller width with sides being opposed in the circumferential direction of the cam ring and a larger width with sides being opposed in the radial direction of the cam ring, the smaller width being nearly equal to an outer diameter of the second positioning pin, the larger width being larger than the smaller width.

By this, when the operation of the oil pump causes a temperature rise of working oil and therefore thermal expansion of the cam ring and the first and second housing members, the first and second housing members make thermal expansion displacements that are larger than that of the cam ring since the first and second housing members are larger in the line expansion coefficient than the cam ring.

In this instance, the first and second housing member on the first positioning pin side are integrally connected to the cam ring by means of the first positioning pin. On the other hand, the first and second housing members on the second positioning pin side are movable relative to the cam ring by the effect of the elongated hole.

For this reason, by relatively larger displacements of the first and second housing members due to thermal expansion, the second positioning pin is moved within second axial hole in the direction opposite to the first positioning pin. By this, the cam ring is moved a little in the direction from the shallowest mesh portion to the deepest mesh portion.

Accordingly, the internal gear is moved a little in the corresponding direction to cause the tip end of one tooth of the internal gear to be pressed against the tip end of the corresponding tooth of the external gear, thus eliminating the space between the meshing internal and external teeth at the shallowest mesh portion or the sealing land portion, which is so-called a tip clearance.

For this reason, it becomes possible to prevent leakage of working oil from the adjacent discharge port side pump chamber to the intake port side pump chamber assuredly.

According to a further aspect of the present invention, there is provided an oil pump comprising a cam ring made of a material having a first line expansion coefficient, a pump element having an internal gear rotatably disposed in the cam ring and an external gear meshed with the internal gear, a drive shaft for driving the external gear, a first housing member disposed on one of axially opposite sides of the cam ring and made of a material having a second line expansion coefficient smaller than the first line expansion coefficient, a second housing member disposed on the other of the axially opposite sides of the cam ring and made of a material having a third line expansion coefficient smaller than the first line expansion coefficient, an intake port formed in one of the first housing member and the second housing member so as to be open to a plurality of pump chambers of the pump element, which are in a range where the pump chambers increase in volume in accordance with rotation of the drive shaft, a discharge port formed in one of the first housing member and the second housing member so as to be open to a plurality of pump chambers of the pump element, which are in a range where the pump chambers decrease in volume in accordance with rotation of the drive shaft, a first axial hole formed in the cam ring at a circumferential position corresponding to a deepest mesh portion where corresponding one of the pump chambers becomes minimum in volume, a second axial hole formed in the cam ring at a circumferential position corresponding to a shallowest mesh portion where corresponding one of the pump chambers becomes maximum in volume, a first positioning pin press-fitted in the first axial hole and in an axial hole formed in one of the first housing member and the second housing member, and a second positioning pin press-fitted in the second axial hole and in an axial hole formed in one of the first housing member and the second housing member, wherein the second axial hole corresponds in shape to the second positioning pin, and wherein the first axial hole has a smaller width with sides opposed in the circumferential direction of the cam ring and a larger width with sides opposed in the radial direction of the cam ring, the smaller width being nearly equal to an outer diameter of the first positioning pin, the larger width being larger than the smaller width.

By this, when thermal expansion of the first and second housing members due to a temperature rise of working oil is caused by the operation of the oil pump, thermal expansion displacement of the cam ring, which is larger than that of the housing members, is caused since the cam ring is larger in line expansion coefficient than the first and second housing members.

In this instance, the first and second housing members on the second positioning pin side are connected integrally to the cam ring by the second positioning pin. On the other hand, the first and second housing members on the first positioning pin side are connected to the cam ring so as to allow the cam ring to be movable relative to the first and second housing members by the effect of the elongated hole.

For this reason, thermal expansion of the cam ring causes the distance between the axes of the first positioning pin and the second positioning pin to increase and therefore the cam ring to move a little in the direction from the shallowest mesh portion side to the deepest mesh portion side.

This causes the internal gear to move a little in the corresponding direction, thus causing the tip end of the internal tooth at the shallowest mesh portion to be pressed against the tip end of the external tooth and thereby eliminating the so-called tip clearance.

Thus, it becomes possible to prevent leakage of working oil from the adjacent discharge port side pump chamber to the intake port side pump chamber assuredly.

DESCRIPTION OF THE PREFERRED EMBODIMENTS

Figure 1:
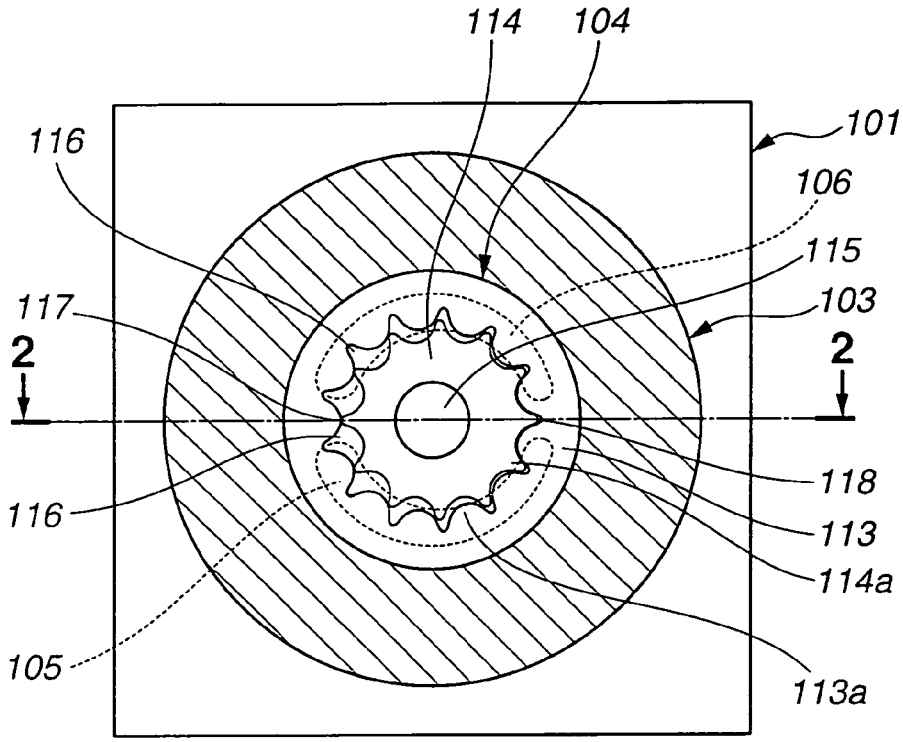
FIG. 1 is a schematic view of an oil pump according to a first embodiment of the present invention.
Figure 2:
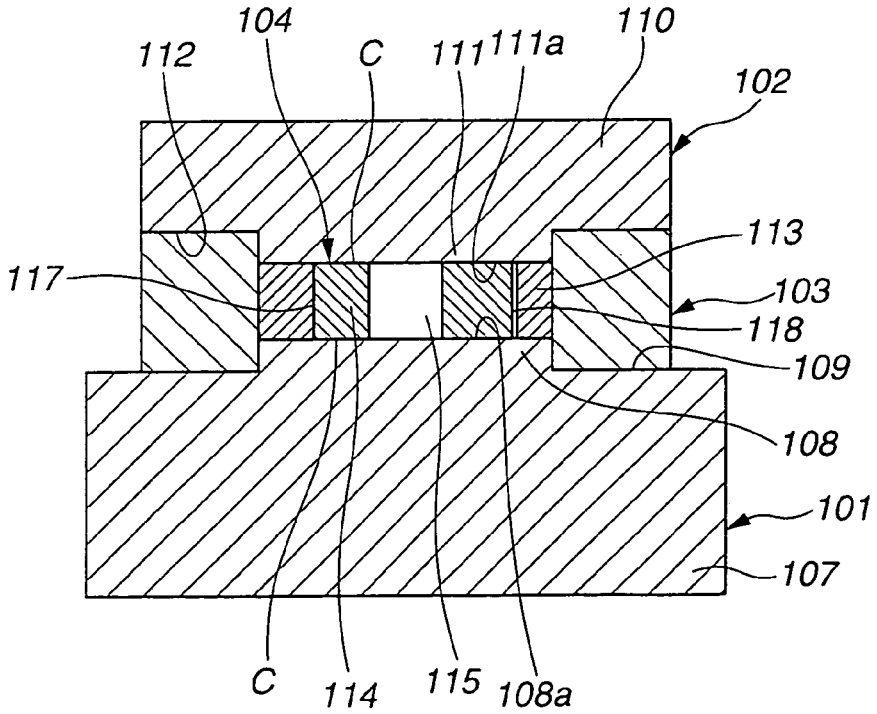
FIG. 2 is a sectional view taken along the line 2-2 of FIG. 1.

Referring first to FIGS. 1 and 2, an oil pump according to an embodiment of the present invention is a so-called reversible oil pump (trochoid gear pump) for selectively supplying pressurized oil for assist of steering to a power cylinder of a power steering system for an automotive vehicle.

The oil pump includes a first housing member 101 in the form of a thick block, a second housing member 102 in the form of a thick block and opposed to first housing member 101, cam ring 103 in the form of a circular ring and interposed between first and second housing members 101 and 102, pump element 104 rotatably disposed in cam ring 103, and intake (discharge) port 105 and discharge (intake) port 106 formed in first housing member 101 so as to be opposed to each other and be arcuated or part-circular in shape.

First housing member 101 is made of an aluminum alloy and formed into a single piece. First housing member 101 includes rectangular main body 107 and first disk-shaped protruded section 108 provided to one side of main body 107. At a place outside the outer circumferential periphery of first protruded section 108, first housing 101 has a first receding step surface 109 as a first abutment surface in the claims. Further, first protruded section 108 is configured so that its outer diameter is a little smaller than the inner diameter of cam ring 103 and its flat circular axial end surface constitutes a first abutment surface 108*a* as a second abutment surface in the claims associated with pump element 104.

Second housing member 102 is also made of an aluminum alloy and formed into a single piece. Second housing member 102 includes a disk-shaped main body 110 having nearly the same outer diameter as cam ring 103 and a second disk-shaped protruded section 111 provided to one side of main body 110. At a place outside the outer circumferential periphery of second protruded section 111, second housing member 102 has second receding step surface 112 as a third abutment surface in the claims. Further, second protruded section 111 is configured so as to have the outer diameter that is nearly the same as that of first protruded section 108 and a little smaller than the inner diameter of cam ring 103 and a flat circular axial end surface that serves as a second abutment surface 111*a* as a fourth abutment surface in the claims associated with pump element 4. Instead of having the intake port 105 and discharge port 106 formed in the first housing member, as stated above, the intake port and the discharge port can be formed in the fourth abutment surface of the second housing member.

Further, first and second housing members 101 and 102 are connected to each other by means of fixing pins (not shown) that are press-fitted at opposite axial ends in press-fit holes formed in opposed surfaces of both main bodies 107 and 110.

Cam ring 103 is made of cast iron that is smaller in line expansion coefficient than the aluminum alloy of first and second housing members 101 and 102. Cam ring 103 is fitted on the outer peripheries of both protruded sections 108 and 111 of first and second housing members 101 and 102 and held in abutting engagement with step surfaces 109 and 112. Further, though not shown, cam ring 103 has a plurality of axial through holes that are arranged at predetermined circumferential positions and that are elongated holes having a larger width in the radial direction of cam ring 103.

Pump element 104 includes an annular internal gear 113 (meaning an internally toothed gear) rotatably supported on an inner circumferential periphery of cam ring 103 and having internal teeth 113*a*, an external gear 114 (meaning an externally toothed gear) disposed eccentrically within internal gear 113 and having a plurality of external teeth 114*a* meshed with internal teeth 113*a* of internal gear 113, and drive shaft 115 connected concentrically to external gear 114 and driven by a motor (not shown) though a portion of drive shaft 115 extending through first and second housing members 101 and 102 which is omitted for brevity. External teeth 114*a* of external gear 114 and internal teeth 113*a* of internal gear 113 are defined by trochoid.

Internal gear 113 and external gear 114 are sized so as to be a little smaller in axial width or length than cam ring 103 and adapted to define a plurality of pump chambers 116 between internal teeth 113*a* and external teeth 114*a*.

Pump chambers 116 vary in volume in accordance with rotation of internal and external gears 113 and 114 so that working oil is sucked thereinto when pump chambers 116 are positioned in a region of intake port 105 and discharge working oil when pump chambers 116 positioned in a region of discharge port 106. At one of boundary regions between intake port 105 and discharge port 106, there is provided a seal land portion or a shallowest mesh portion 117 at which a tip end of internal tooth 113*a* of internal gear 113 and a tip end of external tooth 114*a* of external gear 114 are brought into contact with each other. Further, in this boundary region, pump chamber 116 becomes maximum in volume.

Further, in the other of the boundary regions, there is provided a deepest mesh portion at which the deepest meshing of internal tooth 113*a* and external tooth is obtained and pump chamber 116 becomes minimum in volume.

Further, between each of first and second abutment surfaces 108*a* and 111*a* of protruded sections 108 and 111 of first and second housing members 101 and 102 and each of opposite axial end surfaces of internal gear 113 and external gear 114, there is provided a fine side clearance C.

Accordingly, when external gear 114 is driven by an electric motor by way of drive shaft 115, internal gear 114 is caused to rotate together with external gear 114, thus causing a temperature rise of working oil and therefore thermal expansion of cam ring 103 and first and second housing members 101 and 102.

Since first and second housing members 101 and 102 are larger in line expansion coefficient than cam ring 103, they make substantially the same thermal expansion displacement that is larger than that of cam ring 103 and are moved in the direction to hold therebetween cam ring 103, i.e., in the direction to cause protruded sections 108 and 111 to move toward the opposite axial end surfaces of internal and external gears 113 and 114.

Thus, side clearance C provided between each of first and second abutment surfaces 108*a* and 111*a* of protruded sections 108 and 111 and each of the opposite axial end surfaces of internal and external gears 113 and 114 is decreased. Simultaneously with this, the space between each of step surfaces 109 and 112 of housing members 101 and 102 and each of the opposite axial end surfaces of cam ring 103 is eliminated so that housing members 101, 102 and cam ring 103 are put into fitting contact with each other.

Accordingly, it becomes possible to prevent high pressure working oil within pump chambers 116 on the discharge port 106 side from leaking to the outside through side clearances C. As a result, lowering of the pump efficiency can be prevented.

Further, when the temperature is low and the viscosity resistance of working oil is large, the thermal expansion displacements of housing members 101 and 102 toward pump element 104 are small so that side clearances C are held at a suitably large amount, thus making it possible to prevent occurrence of sliding resistance between housing member 101 or 102 and pump element 104 due to rotation of pump element 4.

Particularly, since it is adapted in this embodiment, as described above, to prevent leakage of working oil not by using a spacer member as in the prior art but by using the difference in the thermal expansion displacement between each of housing members 107, 110 and cam ring 103, thus making it possible to simplify the structure of the overall device and thereby improve the manufacturing and assembling efficiencies while reducing the cost.

Further, by forming first and second housing members 101 and 102 that are relatively large in volume from an aluminum alloy that is relatively small in specific gravity while forming cam ring 3 that is required to have a high durability from an iron-system material, it becomes possible to satisfy both of the requirement for making the entire oil pump lighter in weight and the requirement for making the oil pump more durable.

Figure 3:
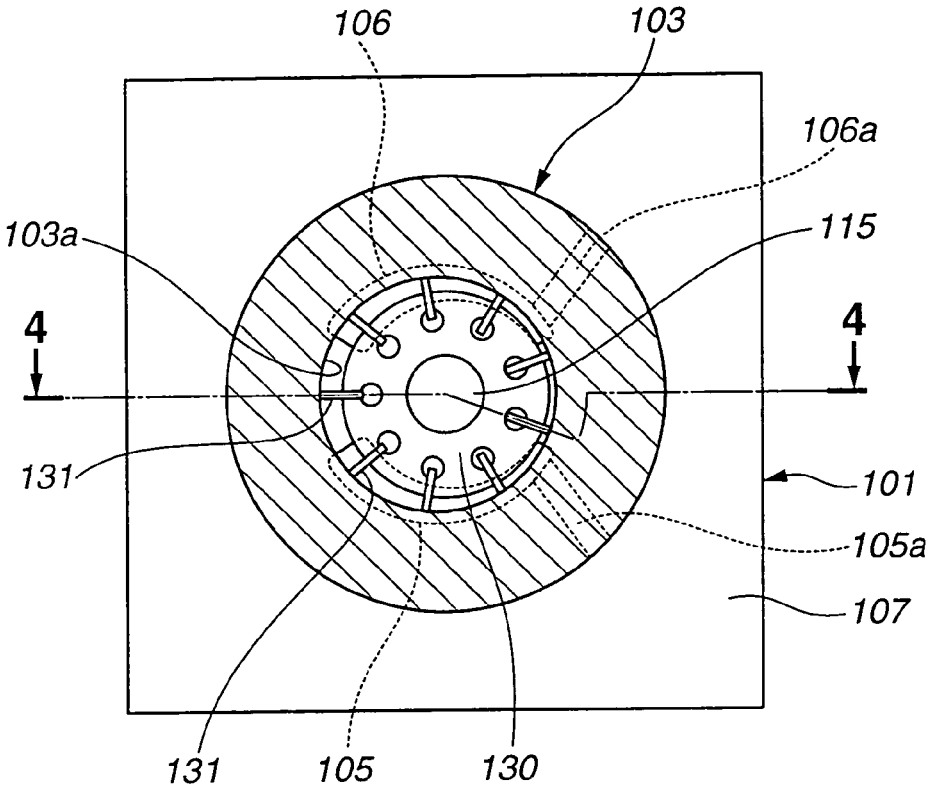
FIG. 3 is a schematic view of an oil pump according to another embodiment of the present invention.
Figure 4:
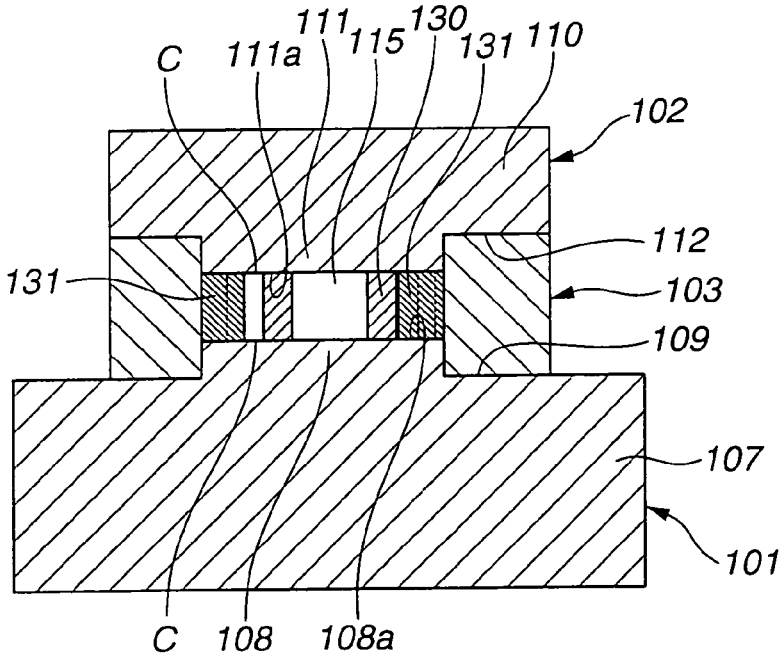
FIG. 4 is a sectional view taken along the line 4-4 of FIG. 3.

FIGS. 3 and 4 show a second embodiment in which the present invention is applied to a vane pump. The second embodiment is similar in the basic constituent parts or elements such as the housing members to the previous embodiment described with reference to FIGS. 1 and 2, so that like parts to those of the previous embodiment will be designated by like reference characters.

Namely, first and second housing members 101 and 102 are made of an aluminum alloy, and cam ring 103 is made of cast iron.

First housing member 101 is formed with an arcuated intake port 105, an arcuated discharge port 106, an intake passage 105*a* for supplying working oil to intake port 105 and an discharge passage 106 for supplying working oil discharged from discharge port 106 to external machines and devices.

Further, rotatably disposed within eccentric hole 103*a* of cam ring 103 is a vane rotor 130 fixed to a drive shaft 115 though a portion of drive shaft 115 extending through first and second housing members 101 and 102 is omitted for brevity. Vane rotor 130 has at an outer circumferential periphery a plurality of radial slots in which vanes 131 are received slidably.

Accordingly, when the temperature of working oil becomes high to cause thermal expansion of both housing members 101 and 102, each side clearance C between each of first and second abutment surfaces 108*a*, 111*a* and each of axially opposite side surfaces of rotor 130 and each side clearance C between each of first and second abutment surfaces 108*a*, 111*a* and each of opposite side surfaces of each vane 131 are decreased. Simultaneously with this, the space between each of step surfaces 109 and 112 of housing members 101 and 102 and each of opposite axial end surfaces of cam ring 102 is eliminated to cause first and second housing members 101, 102 and cam ring 103 to fittingly contact with each other.

Accordingly, it becomes possible to prevent leakage of working oil through side clearances C assuredly. As a result, it becomes possible to prevent the pump efficiency from being lowered.

Figure 5:
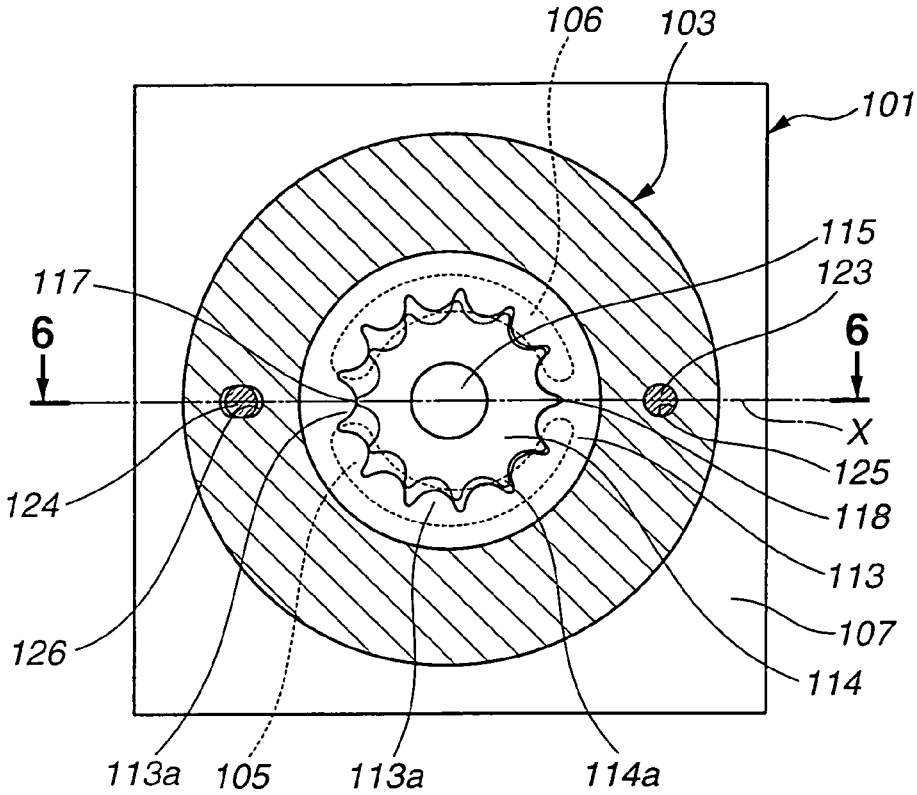
FIG. 5 is a schematic view of an oil pump according to a further embodiment of the present invention.
Figure 6:
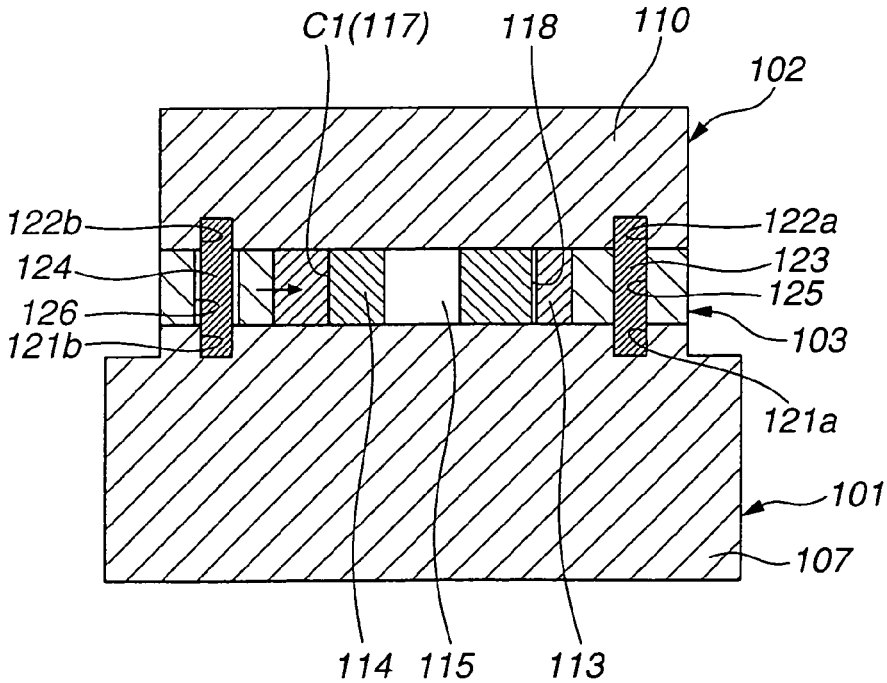
FIG. 6 is a sectional view taken along the line 6-6 in FIG. 5.

FIGS. 5 and 6 show a further embodiment of the present invention. This embodiment is substantially similar in the basic constituent parts or elements to the previous embodiment described with reference to FIGS. 1 and 2, so that like parts and portions to those of the previous embodiment of FIGS. 1 and 2 are designated by like reference characters and detailed description thereto is omitted for brevity.

Similarly to the previous embodiment, first and second housing members 101 and 102 are made of an aluminum alloy having a large line expansion coefficient, and cam ring 103 is made of an iron-system material such as cast iron and sintered metal having a small line expansion coefficient.

First and second housing members 101 and 102 have at opposite side surfaces of main bodies 107 and 110 and at corresponding positions thereof first and second press-fit holes 121*a*, 121*b*, 122*a* and 122*b*. As shown in FIG. 5, press-fit holes 121*a*, 121*b*, 122*a* and 122*b* are formed so as to be located on a diametral line X on which shallowest mesh portion 117 and deepest mesh portion 118 are located and on the diametrically opposite sides corresponding to deepest mesh portion 117 and shallowest mesh portion 118, respectively. Further, into force-fit holes 121*a*, 121*b*, 122*a* and 122*b* are press-fitted first and second positioning pins 123 and 124 thereby connecting housing members 101 and 102 to each other.

On the other hand, cam ring 103 has at diametrically opposite positions on diametrical line X on which shallowest mesh portion 117 and deepest mesh portion 118 are located, first and second axial holes 125 and 126 through which first and second positioning pins 123 and 124 extend.

First axial hole 125 on the deepest mesh portion 118 side is formed so as to be nearly equal in the inner diameter to first press-fit holes 121*a* and 121*b* so that first positioning pin 123 is press-fitted in first axial hole 125.

On the other hand, second axial hole 126 on the shallowest mesh portion 117 side is formed into such an elongated hole that allows positioning pin 124 to be radially movable relative to cam ring 103 and in the direction from shallowest mesh portion 117 to deepest mesh portion 118 or vice versa.

Accordingly, when a temperature rise of working oil and therefore thermal expansion of first and second housing members 101 and 102 is caused by the operation of the oil pump, first and second housing members 101 and 102 make a larger displacement than cam ring 103 since first and second housing members 101 and 102 are larger in line expansion coefficient than cam ring 103.

In this instance, on the first positioning pin 123 side, first and second housing members 101 and 102 are integrally connected to cam ring 103 by means of first positioning pin 123. On the other hand, on the second positioning pin 124 side, first and second housing members 101 and 102 are coupled so as to be movable relative to cam ring 103 by the effect of second axial hole 126 that is the elongated hole. For this reason, by relatively larger thermal expansion displacements of first and second housing members 101 and 102, second positioning pin 124 is moved within second axial hole 126 in the direction opposite to first positioning pin 123, thus increasing the distance between the axes of first and second positioning pins 124 and 125.

Accordingly, cam ring 103 is moved a little from the shallowest engagement portion 117 side to the deepest engagement portion 118 side as indicated by the arrow in FIG. 6.

By this, internal gear 113 is moved in the corresponding direction to allow the tip end of internal tooth 113*a* at shallowest engagement portion 117 to be pressed against the tip end of external tooth 114*a*, thus making it possible to eliminate a tip clearance C1 that is a clearance in mesh between internal tooth 113*a* and external tooth 114*a*.

For this reason, it becomes possible to prevent leakage of working oil from pump chamber 116 on the discharge port 106 side to pump chamber 116 on the intake port 105 side assuredly.

Figure 7:
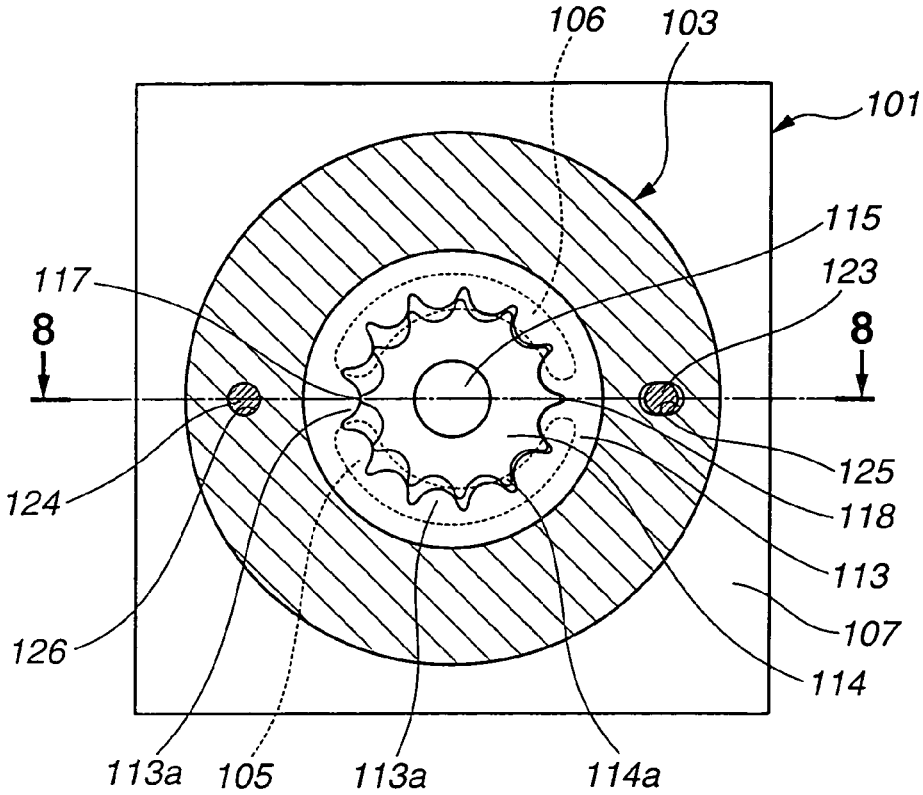
FIG. 7 is a schematic view of an oil pump according to a further embodiment of the present invention.
Figure 8:
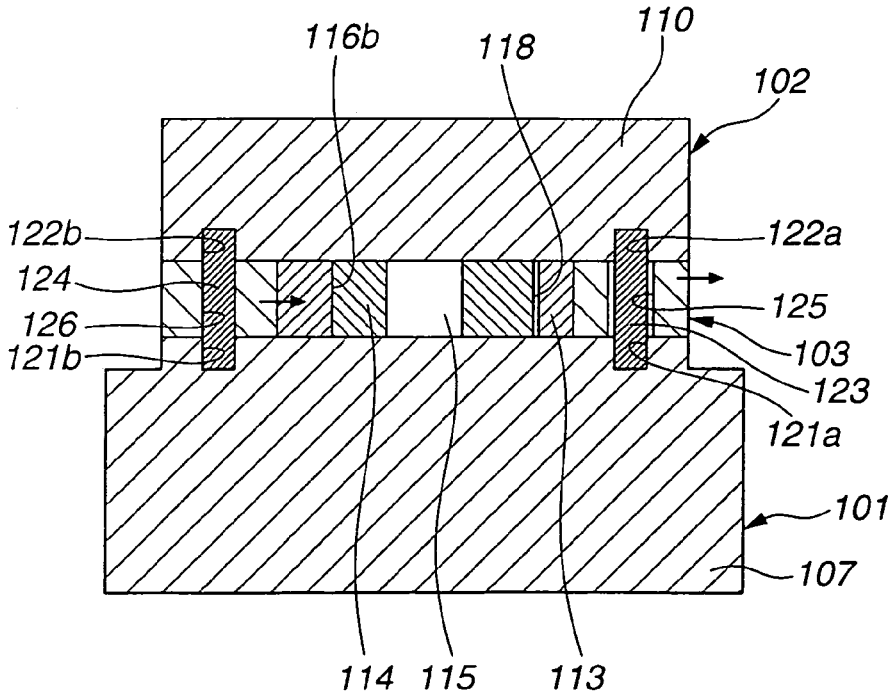
FIG. 8 is a sectional view taken along the line 8-8 in FIG. 7.

FIGS. 7 and 8 show a further embodiment of the present invention. This embodiment differs from the previous embodiment described with reference to FIGS. 5 and 6 in that first and second housing members 101 and 102 are made of cast iron having a small line expansion coefficient and cam ring 103 is made of an aluminum alloy having a large line expansion coefficient.

Further, first axial hole 125 on the deepest mesh portion 118 side where the pump capacity is minimum is formed into an elongated hole that allows first positioning pin 123 to move together with cam ring 103 in the direction from the shallowest mesh portion 117 side to the deepest mesh portion 118 side.

On the other hand, second axial hole 126 on the shallowest mesh portion 117 side where the pump capacity becomes maximum is formed so as to have substantially the same inner diameter as second press-fit hole 122*b* and 121*b*, and second positioning pin 124 is press-fitted in second axial hole 126.

Accordingly, by this embodiment, when thermal expansion of first and second housing members 101 and 102 due to a temperature rise of working oil is caused by the operation of the oil pump, thermal expansion displacement of cam ring 103, which is larger than that of housing members 101 and 102, is caused since cam ring 103 is larger in line expansion coefficient than first and second housing members 101 and 102.

In this instance, first and second housing members 101 and 102 on the second positioning pin 124 side are connected integrally to cam ring 103 by second positioning pin 124. On the other hand, first and second housing members 101 and 102 on the first positioning pin 123 side are connected to cam ring 103 so as to allow cam ring 103 to be movable relative to first and second housing members 101 and 102 by means of first axial hole 125.

For this reason, thermal expansion displacement of cam ring 103 causes cam ring 103 to move a little in the direction from the shallowest mesh portion 117 side to the deepest mesh portion 118 side as indicated by the arrow in FIG. 8 by the effect of first axial hole 125 formed into an elongated hole.

This causes internal gear 113 to move a little in the corresponding direction, thus causing the tip end of internal tooth 113*a* at the shallowest mesh portion 117 to be pressed against the tip end of external tooth 114*a* and thereby eliminating the so-called tip clearance C1.

Thus, it becomes possible to prevent leakage of working oil from the discharge port 106 side to the intake port 105 side assuredly.

The entire contents of Japanese Patent Applications P2004-212398 (filed Jul. 21, 2004) are incorporated herein by reference.

Although the invention has been described above by reference to a certain embodiment of the invention, the invention is not limited to the embodiment described above. Modifications and variations of the embodiment described above will occur to those skilled in the art, in light of the above teachings. For example, the first and second housing members may be made of the same metallic material or different metallic materials. Further, while the present invention has been described and shown as being applied to the reversible pump, this is not for the purpose of limitation. The present invention can be applied to one-way type oil pump. The scope of the invention is defined with reference to the following claims.

What is claimed is:

1. An oil pump comprising:

a cam ring made of a material having a first line expansion coefficient;

a pump element rotatably disposed in the cam ring and smaller in axial length than the cam ring;

a drive shaft for driving the pump element;

a first housing member disposed on one of axially opposite sides of the cam ring, made of a material having a second line expansion coefficient larger than the first line expansion coefficient and having a first abutment surface in abutting engagement with one of opposite axial end surfaces of the cam ring and a second abutment surface in abutting engagement with one of opposite axial end surfaces of the pump element;

a second housing member disposed on the other of the axially opposite sides of the cam ring, made of a material having a third line expansion coefficient larger than the first line expansion coefficient and having a third abutment surface in abutting engagement with the other of the opposite axial end surfaces of the cam ring and a fourth abutment surface in abutting engagement with the other of the opposite axial end surfaces of the pump element;

an intake port formed in one of the first housing member and the second housing member at a position corresponding to an intake range of the pump element; and a discharge port formed in one of the first housing member and the second housing member at a position corresponding to a discharge range of the pump element.

2. An oil pump according to claim 1, wherein the cam ring is made of an iron-system material, and the first housing member and the second housing member are made of an aluminum alloy.

3. An oil pump according to claim 2, wherein the cam ring is made of sintered metal.

4. An oil pump according to claim 2, wherein the first housing member and the second housing member are made of the same material.

5. An oil pump according to claim 1, wherein the intake port and the discharge port are formed in the fourth abutment surface of the second housing member.

6. An oil pump according to claim 1, wherein the pump element comprises an internal gear and an external gear.

7. An oil pump according to claim 6, wherein the oil pump is of a trochoid type.

8. An oil pump according to claim 1, wherein the oil pump is a vane-pump including a rotor having a plurality of radial slots and a plurality of vanes radially slidably disposed in the slots.

9. An oil pump according to claim 1, further comprising positioning pins extending through the cam ring for fixing the first housing member and the second housing member to each other.

10. An oil pump according to claim 1, wherein the oil pump is a reversible pump and the drive shaft is driven in opposite directions.

* * * * *